US007275387B2

(12) United States Patent
Gist et al.

(10) Patent No.: US 7,275,387 B2
(45) Date of Patent: Oct. 2, 2007

(54) INTEGRATED ICE AND BEVERAGE DISPENSER

(75) Inventors: David Brett Gist, Grayslake, IL (US); Matthew Allison, Mundelein, IL (US); Daniel Leo Ziolkowski, Barrington, IL (US); Michael Kraus, Lake Villa, IL (US); Michael J. Andresen, Round Lake Beach, IL (US)

(73) Assignees: Scotsman Ice Systems, Vernon Hills, IL (US); Mile High Equipment Co., Denver, CO (US)

( * ) Notice: Subject to any disclaimer, the term of this patent is extended or adjusted under 35 U.S.C. 154(b) by 0 days.

(21) Appl. No.: 11/205,724

(22) Filed: Aug. 17, 2005

(65) Prior Publication Data

US 2006/0016206 A1 Jan. 26, 2006

Related U.S. Application Data

(60) Division of application No. 10/683,578, filed on Oct. 10, 2003, now Pat. No. 7,017,353, which is a continuation-in-part of application No. 10/147,441, filed on May 16, 2002, now Pat. No. 6,691,528, which is a continuation-in-part of application No. 09/952,143, filed on Sep. 14, 2001, now Pat. No. 6,637,227.

(60) Provisional application No. 60/233,392, filed on Sep. 15, 2000.

(51) Int. Cl.
*F25C 5/18* (2006.01)

(52) U.S. Cl. ..... 62/389; 62/344

(58) Field of Classification Search ..... 62/340–356, 62/389–400; 222/146.6
See application file for complete search history.

(56) References Cited

U.S. PATENT DOCUMENTS 2,624,179 A 1/1953 Daisy ..... 62/217
3,059,444 A 10/1962 Bickel et al. ..... 62/217

(Continued)

FOREIGN PATENT DOCUMENTS

EP 0992749 4/2000

OTHER PUBLICATIONS

Kold Draft Service Manual (W4000), 1990.

(Continued)

*Primary Examiner*—William E. Tapolcai
(74) *Attorney, Agent, or Firm*—Ohlandt, Greeley, Ruggiero & Perle L.L.P.

(57) ABSTRACT

An ice cube-making machine that is characterized by noiseless operation at the location where ice cubes are dispensed and be lightweight packages for ease of installation. The ice cube-making machine has an evaporator package, a separate compressor package and a separate condenser package. Each of these packages has a weight that can generally by handled by one or two installers for ease of installation. The noisy compressor and condenser packages can be located remotely of the evaporator package. The maximum height distance between the evaporator package and the condenser package is greatly enhanced by the three package system. A pressure regulator operates during a harvest cycle to limit flow of refrigerant leaving the evaporator, thereby increasing pressure and temperature of the refrigerant in the evaporator and assisting in defrost thereof. The evaporator can be integrated with a beverage dispenser and an ice dispenser.

7 Claims, 11 Drawing Sheets

U.S. PATENT DOCUMENTS

| | | | | | |
|---|---|---|---|---|---|
| 3,358,469 | A | | 12/1967 | Quick | 62/196.2 |
| 3,766,744 | A | | 10/1973 | Morris, Jr. | 62/73 |
| 3,827,256 | A | | 8/1974 | Wiesner | 62/330 |
| 3,838,582 | A | | 10/1974 | Redfer et al. | 62/196 |
| 3,865,517 | A | | 2/1975 | Simmons et al. | 417/424.1 |
| 3,922,874 | A | | 12/1975 | Morris, Jr. | 62/156 |
| 4,013,120 | A | | 3/1977 | Rheinheimer | 165/48 |
| 4,089,040 | A | | 5/1978 | Paulsen | 361/383 |
| 4,171,622 | A | | 10/1979 | Yamaguchi et al. | 62/160 |
| 4,185,467 | A | | 1/1980 | Garland | 62/81 |
| 4,276,751 | A | * | 7/1981 | Saltzman et al. | 62/138 |
| 4,324,109 | A | | 4/1982 | Garland | 62/353 |
| 4,338,794 | A | | 7/1982 | Haasis, Jr. | 62/348 |
| 4,373,345 | A | | 2/1983 | Tyree, Jr. et al. | 62/79 |
| 4,378,680 | A | | 4/1983 | Garland | 62/352 |
| 4,625,524 | A | | 12/1986 | Kimura et al. | 62/278 |
| 4,688,392 | A | | 8/1987 | Fujimoto et al. | 62/174 |
| 4,735,059 | A | | 4/1988 | O'Neal | 62/196.4 |
| 4,774,815 | A | | 10/1988 | Schlosser | 62/149 |
| 4,775,815 | A | | 10/1988 | Schlosser | 62/149 |
| 4,850,197 | A | | 7/1989 | Taylor et al. | 62/81 |
| 4,854,130 | A | | 8/1989 | Naruse et al. | 62/352 |
| 4,878,361 | A | | 11/1989 | Kohl et al. | 62/352 |
| 4,907,422 | A | | 3/1990 | Kohl et al. | 62/352 |
| 4,981,023 | A | | 1/1991 | Krishnakumar et al. | 62/498 |
| 5,056,327 | A | | 10/1991 | Lammert | 62/151 |
| 5,058,395 | A | | 10/1991 | Ni et al. | 62/278 |
| 5,077,982 | A | | 1/1992 | Shaffer, Jr. | 62/199 |
| 5,131,234 | A | | 7/1992 | Furunkawa et al. | 62/137 |
| 5,165,255 | A | | 11/1992 | Alvarez et al. | 62/344 |
| 5,167,130 | A | | 12/1992 | Morris, Jr. | 62/196.1 |
| 5,174,123 | A | | 12/1992 | Erickson | 62/113 |
| 5,218,830 | A | | 6/1993 | Martineau | 62/73 |
| 5,230,448 | A | * | 7/1993 | Strohmeyer et al. | 222/643 |
| 5,293,757 | A | | 3/1994 | Nishio | 62/344 |
| 5,363,671 | A | * | 11/1994 | Forsythe et al. | 62/197 |
| 5,445,290 | A | * | 8/1995 | Forsythe et al. | 222/129.1 |
| 5,743,098 | A | | 4/1998 | Behr | 62/199 |
| 5,755,106 | A | | 5/1998 | Ross | 62/217 |
| 5,787,723 | A | * | 8/1998 | Mueller et al. | 62/347 |
| 5,842,352 | A | | 12/1998 | Gregory | 62/151 |
| 5,950,866 | A | * | 9/1999 | Lancaster | 222/1 |
| 6,009,715 | A | * | 1/2000 | Sakurai et al. | 62/197 |
| 6,112,534 | A | | 9/2000 | Taras et al. | 62/217 |
| 6,145,324 | A | | 11/2000 | Dolezal | 62/73 |
| 6,196,007 | B1 | * | 3/2001 | Schlosser et al. | 62/73 |
| 6,405,553 | B1 | | 6/2002 | Willett | 62/298 |
| 6,431,414 | B2 | * | 8/2002 | Jaleel et al. | 222/413 |
| 6,637,227 | B2 | * | 10/2003 | Stensrud et al. | 62/217 |
| 6,691,528 | B2 | * | 2/2004 | Stensrud et al. | 62/344 |
| 6,952,935 | B2 | * | 10/2005 | Vorosmarti et al. | 62/344 |

OTHER PUBLICATIONS

Crystal Tips Ice Machine CAE 101B Service Manual, Apr. 1974.
Vogt HEC Series Tube-Ice Machines Service Manual, Jun. 27, 1995.
European Search Report dated Dec. 5, 2006 based on application No. 06019659.9-2301.

* cited by examiner

INTEGRATED ICE AND BEVERAGE DISPENSER

CROSS-REFERENCE TO RELATED APPLICATIONS

This Application is a division of, and claims priority in, U.S. patent application Ser. No. 10/683,578, filed on Oct. 10, 2003 now U.S. Pat. No. 7,017,353, which is a continuation in part of U.S. patent application Ser. No. 10/147,441, filed on May 16, 2002 now U.S. Pat. No. 6,694,528, which is a continuation in part of U.S. patent application Ser. No. 09/952,143 filed on Sep. 14, 2001 now U.S. Pat. No. 6,637,227, which claims the benefit of U.S. Provisional Application No. 60/233,392, filed Sep. 15, 2000, the disclosures of which are incorporated in their entirety by reference herein.

FIELD OF INVENTION

This invention relates to an ice cube-making machine that is quiet at the location where ice is dispensed. This application is also related to integrated ice and beverage dispensers.

BACKGROUND OF INVENTION

Ice cube-making machines generally comprise an evaporator, a water supply and a refrigerant/warm gas circuit that includes a condenser and a compressor. The evaporator is connected to the water supply and to a circuit that includes the condenser and the compressor. Valves and other controls control the evaporator to operate cyclically in a freeze mode and a harvest mode. During the freeze mode, the water supply provides water to the evaporator and the circuit supplies refrigerant to the evaporator to cool the water and form ice cubes. During the harvest mode, the circuit diverts warm compressor discharge gas to the evaporator, thereby warming the evaporator and causing the ice cubes to loosen and fall from the evaporator into an ice bin or hopper.

When installed in a location, such as a restaurant, where a small footprint is needed, ice making machines have been separated into two separate packages or assemblies. One of the packages contains the evaporator and the ice bin and is located within the restaurant. The other package contains the compressor and condenser, which are rather noisy. This package is located remotely from the evaporator, for example, outside the restaurant on the roof. The evaporator package is relatively quiet as the condenser and compressor are remotely located.

This two package ice cube-making machine has some drawbacks. It is limited to a maximum height distance of about 35 feet between the two packages because of refrigerant circuit routing constraints. Additionally, the compressor/condenser package weighs in excess of about 250 pounds and requires a crane for installation. Furthermore, service calls require the mechanic to inspect and repair the compressor/condenser package in the open elements, since it is typically located on the roof of a building. Due to inclement weather, it would be highly desirable to be able to work on the compressor in doors, since it is only the condenser that requires venting to the atmosphere.

During harvest mode, the condenser is bypassed so that refrigerant is supplied from the compressor in vapor phase to the evaporator. When the compressor is located a distance from the evaporator, the refrigerant tends to partially change to liquid phase as it traverses the distance, thereby affecting the efficiency warming or defrosting the evaporator. One prior art solution to this problem uses a heater to heat the vapor supply line. Another prior art solution locates a receiver in the same package as the evaporator and uses the vapor ullage of the receiver to supply vapor to the evaporator. Both of these solutions increase the size of the package and, hence, its footprint in a commercial establishment.

Beverage dispensing machines generally have one or more valves for the dispensing of the beverage. The beverage dispenser may have an ice storage bin for supplying the ice or may have an ice storage structure disposed nearby. Such methods of storage of ice may require time-consuming and labor-intensive manual loading of the ice storage bin. Additionally, such separated systems suffer from the drawback of interface issues, including ice level shut-off, fit, appearance, and condensation on exterior surfaces. Also, any resulting system breakdowns can result in confusion and disagreement as to whether the source of the problem is from the beverage dispenser or the ice dispenser. This can further create problems where separate entities are servicing and/or installing the beverage and ice systems.

Thus, there is a need for a quiet ice cube-making machine that has a larger height distance between the evaporator and the condenser and a lighter weight for installation without the need for a crane. There is also a need for an efficient way of providing vapor to an evaporator during harvest mode. There is a continuing need for a low profile ice making apparatus, which overcomes known installation problems. There is also a need for an ice cube-making machine that has a compact configuration of multiple condensers and a lighter weight for installation. There is a further need for facilitating the dispensing of ice and beverages.

SUMMARY OF INVENTION

The ice cube-making machine of the present invention satisfies the first need with a three package system. The condenser, compressor and evaporator are located in separate ones of the packages, thereby reducing the weight per package and eliminating the need for a crane during installation. The compressor package can be located up to 35 feet in height from the evaporator package. For example, the evaporator package can be located in a restaurant room where the ice cubes are dispensed and the compressor package can be located in a separate room on another floor of the building, such as a utility room. This allows for service thereof to be made indoors, rather than outdoors as required by prior two package systems. The condenser package can be located up to 35 feet in height from the compressor package. For example, the condenser package can be located on the roof of a multistory building.

The evaporator package has a support structure that supports the evaporator. The compressor package has a support structure that supports the compressor. The condenser package has a support structure that supports the condenser.

The present invention satisfies the need for providing vapor to the evaporator during harvest mode by increasing the pressure and temperature of the refrigerant in the evaporator. This is accomplished by connecting a pressure regulator in circuit with the return line between the evaporator and the compressor. The pressure regulator limits flow, which increases pressure and temperature of the refrigerant in the evaporator. To achieve a small footprint of the evaporator package, the pressure regulator can be located in the compressor package.

In one aspect, an integrated ice and beverage (drink) dispensing system is provided that is for use with a compressor, a condenser, a water supply and a beverage source. The system comprises a support structure, a beverage dispenser, and an evaporator. The beverage dispenser is in fluid communication with the beverage source. The evaporator is in fluid communication with the compressor and the condenser for the circulation of refrigerant. The beverage dispenser and the evaporator are connected to the support structure. The support structure is located remotely from the compressor and the condenser. The evaporator is operably connected to the water supply for the formation of ice at the evaporator.

In another aspect, an ice-making machine is provided for use with a water supply and a beverage source. The ice-making machine has an evaporator unit, a compressor unit, a condenser unit and an interconnection structure. The evaporator unit comprises an evaporator and a beverage dispenser. The evaporator is operably connected to the water supply. The beverage dispenser is in fluid communication with the beverage source. The compressor unit comprises a compressor. The condenser unit comprises a condenser. The interconnection structure comprises a plurality of conduits that connect the evaporator, the compressor, and the condenser in a circuit for circulation of refrigerant and forming of ice at the evaporator unit from the water supply.

In yet another aspect, a method of dispensing ice and beverage from a water supply and a beverage source is provided. The method comprises:

positioning an evaporator in close proximity to a beverage dispenser and remotely from a compressor and a condenser with the evaporator being operably connected to the water supply and with the beverage dispenser being in fluid communication with the beverage source;

providing refrigerant substantially in liquid phase to the evaporator from the condenser during a freeze cycle;

providing the refrigerant substantially in vapor phase to the evaporator from the compressor during a harvest cycle with the flow of the refrigerant being limited during the harvest cycle whereby the pressure and temperature of the refrigerant in the evaporator increases to thereby assist in defrosting the evaporator, and with the ice being formed at the evaporator from the water supply; and dispensing the ice and/or dispensing the beverage.

The evaporator unit can be located remotely from the compressor unit and the condenser unit. The evaporator unit, the compressor unit and the condenser unit may also be located remotely from each other. The evaporator unit can also have an ice storage bin and an ice chute with the ice being dispensed from the ice storage bin through the ice chute. The beverage dispenser may be a plurality of beverage dispensers with each of the beverage dispensers being in fluid communication with the beverage source. The evaporator unit can also have a drain operably disposed with respect to the beverage dispenser.

The compressor unit may have a receiver that is connected in the circuit. The compressor unit can have a filter connected in the circuit. The compressor unit can also have an accumulator connected in the circuit. The condenser may be water-cooled, air-cooled or a combination of both. The ice-making machine can also have a pressure regulator disposed in the circuit between the evaporator and the compressor. The pressure regulator may limit the flow of the refrigerant through the evaporator during a harvest cycle. The interconnection structure can have a supply line and a return line. During a freeze cycle, the pressure regulator may operate so as not to impede the flow of the refrigerant through the return line. During the harvest cycle, the pressure regulator may operate so as to reduce the flow of the refrigerant through the return line as compared to the flow of the refrigerant during the freeze cycle, without stopping the flow.

The evaporator unit can also have the receiver connected in the circuit. The ice-making machine may additionally have a vapor circuit. The vapor circuit can have a vapor line and a defrost valve. The vapor line may connect the receiver to the evaporator. During a harvest cycle, the vapor circuit can operate so as to direct the refrigerant in vapor phase to the evaporator to harvest the ice. The ice-making machine can also have a drier disposed in the circuit between the receiver and the evaporator. The ice-making machine may also have the receiver connected in the circuit with the evaporator, the compressor and the condenser, wherein during the harvest cycle the interconnection structure selectively causes the refrigerant to flow to the receiver or causes the refrigerant to bypass the receiver.

The ice-making machine can have a fan, and the compressor unit can be first and second compressor units. The first compressor unit may have a first compressor, and the second compressor unit can have a second compressor. The condenser unit can be disposed in between the first and second compressor units. The fan, when operated, may draw in air to provide cooling to the condenser. The condenser can also be first and second condensers disposed in the condenser unit. The first and second condensers may be disposed in a substantially V-like configuration. The condenser unit can also have first and second apertures. The fan, when operated, may create an air flow path between the first and second apertures to cool the first and second condensers. The air flow path can substantially traverse the first and second condensers.

The interconnection structure can also have a head pressure valve and a bypass valve connected in the circuit with the compressor, the condenser, the evaporator and the receiver. During the harvest cycle, the receiver may be either operable wherein the head pressure valve causes refrigerant to bypass the condenser so as to direct the refrigerant in vapor phase from the compressor to the receiver or the receiver can be inoperable wherein the bypass valve causes the refrigerant to bypass the condenser and the receiver so as to direct the refrigerant from the compressor to the evaporator. The ice-making machine can have a pressure switch that activates the bypass valve. The bypass valve may be a solenoid valve activated during the harvest cycle by the pressure switch. The ice-making machine can also have a controller. The bypass valve may be a solenoid valve activated during the harvest cycle by the controller.

The ice-making machine can also have an accumulator and a heat exchanger. The accumulator may be connected in the circuit between the evaporator and the compressor. The heat exchanger can be disposed in the circuit to optimize refrigerant in liquid phase in the accumulator during the freeze cycle. The heat exchanger may be a tube disposed in thermal relationship to an output line of the accumulator. The heat exchanger can be a tube disposed in thermal relationship with refrigerant inside the accumulator.

BRIEF DESCRIPTION OF DRAWINGS

Other and further objects, advantages and features of the present invention will be understood by reference to the following specification in conjunction with the accompanying drawings, in which like reference characters denote like elements of structure and.

DESCRIPTION OF THE PREFERRED EMBODIMENT

Figure 1:
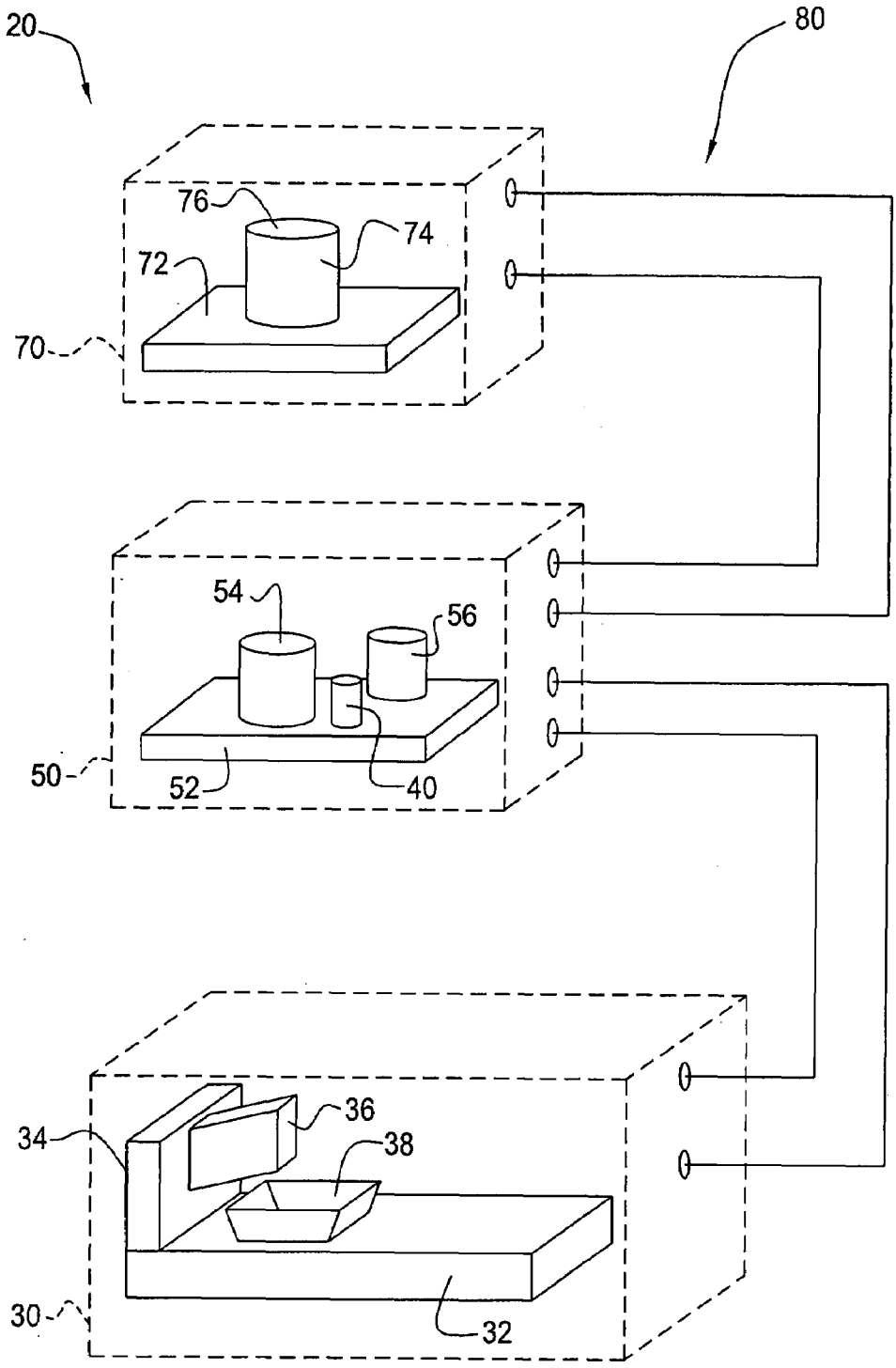
FIG. 1 is a perspective view, in part, and a block diagram, in part, of the ice-making machine of the present invention.

Referring to FIG. 1, an ice cube-making machine 20 of the present invention includes an evaporator package 30, a compressor package 50, a condenser package 70 and an interconnection structure 80. Evaporator package 30 includes a support structure 32 that has an upwardly extending member 34. An evaporator 36 is supported by support structure 32 and upwardly extending member 34. An ice bin or hopper 38 is disposed beneath evaporator 36 to receive ice cubes during a harvest mode.

Compressor package 50 includes a support structure 52 upon which is disposed a compressor 54, an accumulator 56 and a receiver 40. Condenser package 70 includes a support structure 72 upon which is disposed a condenser 74 and a fan 76. It will be appreciated by those skilled in the art that support structures 32, 52 and 72 are separate from one another and may take on different forms and shapes as dictated by particular design requirements. It will be further appreciated by those skilled in the art that evaporator package 30, compressor package 50 and condenser package 70 suitably include various valves and other components of an ice cube-making machine.

Interconnection structure 80 connects evaporator 36, compressor 54 and condenser 74 in a circuit for the circulation of refrigerant and warm gas. Interconnection structure 80 may suitably include pipes or tubing and appropriate joining junctions.

Figure 2:
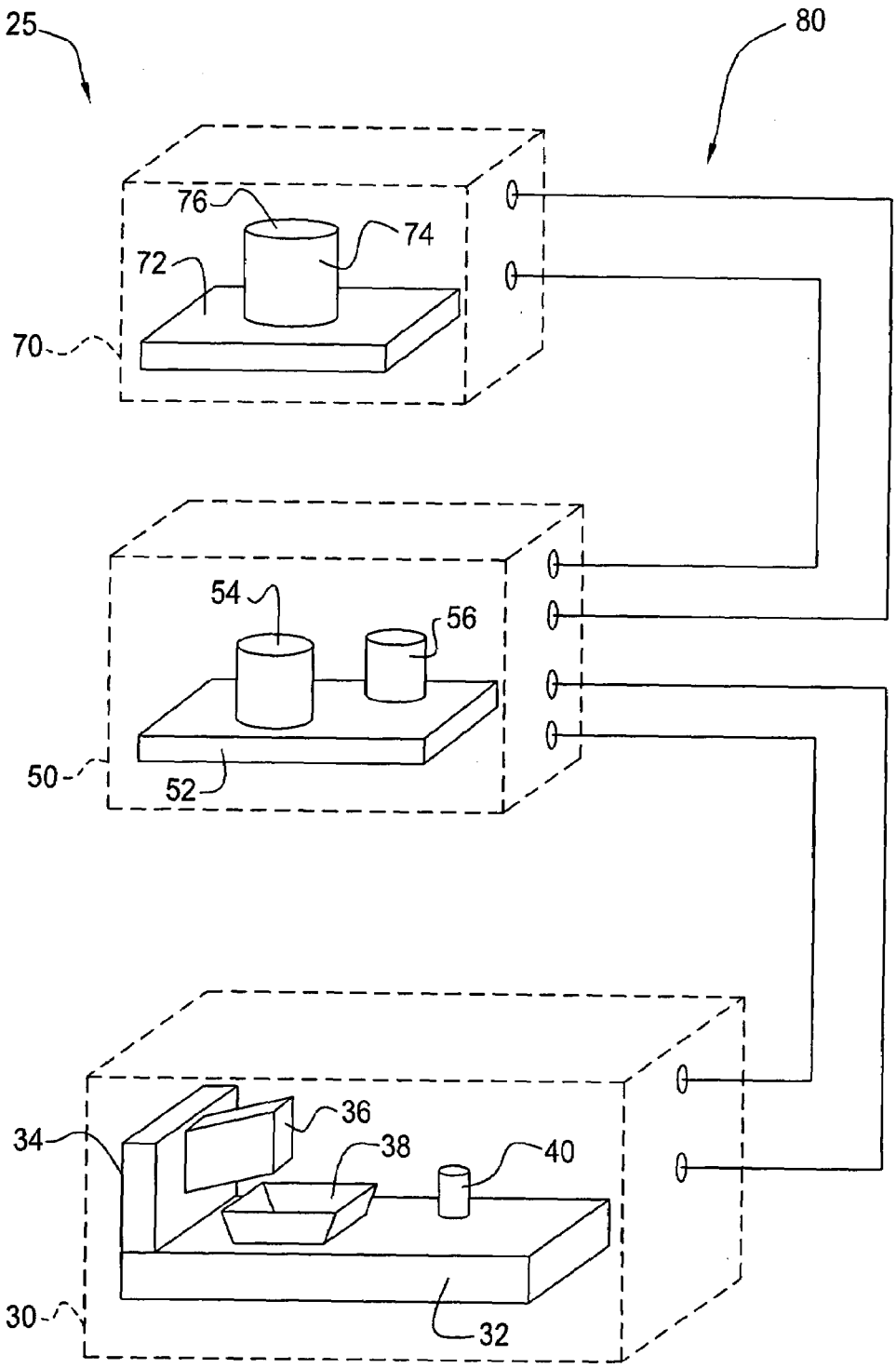
FIG. 2 is a perspective view, in part, and a block diagram, in part, of an alternative embodiment of the ice-making machine of the present invention.

Referring to FIG. 2, an ice-making machine 25 is identical in all respects to ice making machine 20, except that receiver 40 is disposed on support structure 32 in evaporator package 30 rather than in compressor package 50.

Figure 3:
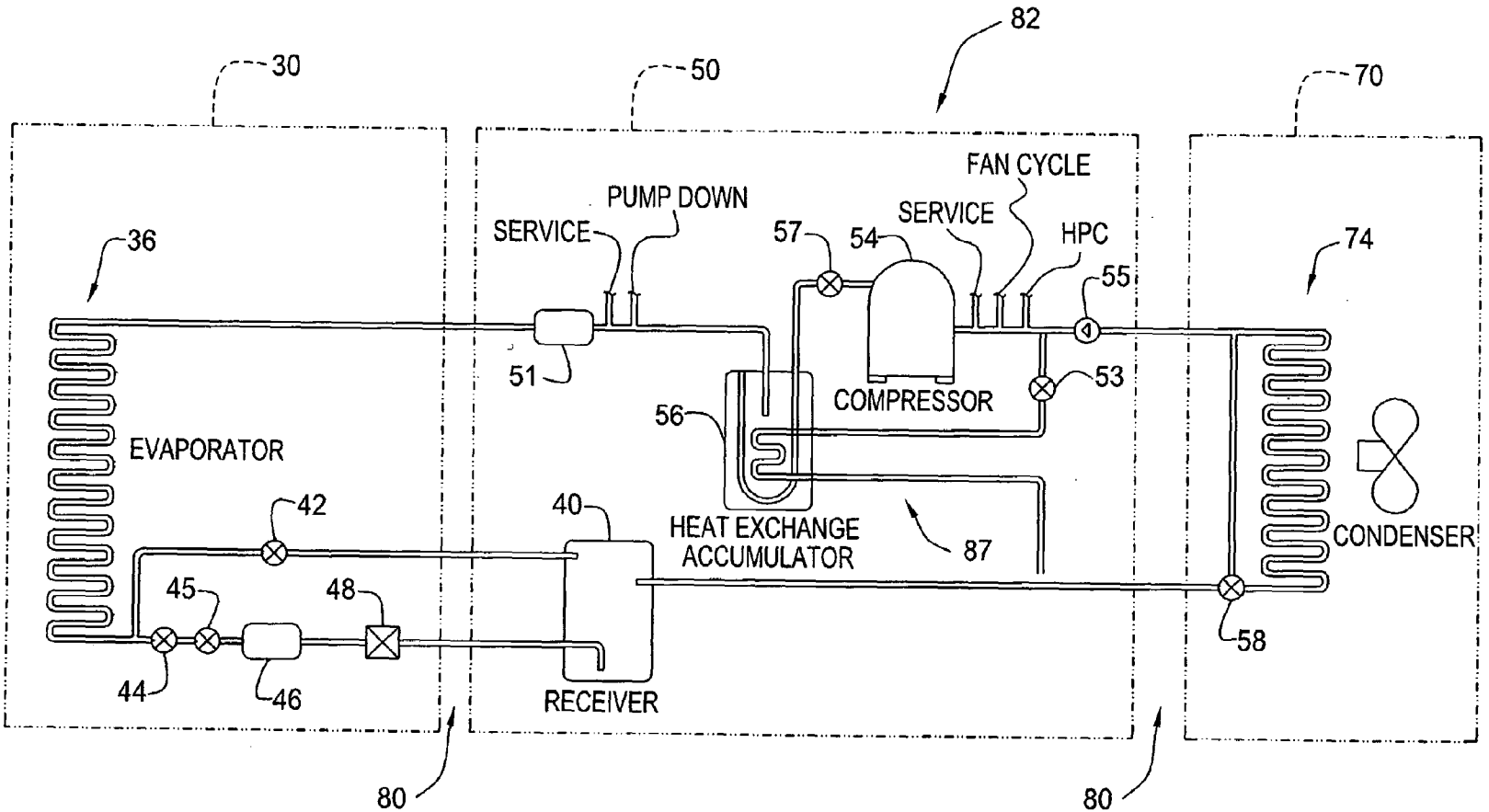
FIG. 3 is a circuit diagram of a refrigerant/warm gas circuit that can be used for the ice-making machine of FIG. 1.

Referring to FIG. 3, a circuit 82 is shown that may be used with the FIG. 1 ice cube-making machine. Circuit 82 includes interconnection structure 80 that connects the components within compressor package 50 to the components within evaporator package 30 and to the components within condenser package 70. In evaporator package 30, evaporator 36 is connected in circuit 82 with a defrost valve 42, an expansion valve 44, a liquid line solenoid valve 45, a drier 46 and an isolation valve 48. In compressor package 50, receiver 40, compressor 54 and accumulator 56 are connected in circuit 82 with a filter 51, a bypass valve 53, a check valve 55 and an output pressure regulator 57. In condenser package 70, condenser 74 is connected in circuit 82 with a head pressure control valve 58. Head pressure control valve 58 may alternatively be placed in compressor package 50. It will be appreciated by those skilled in the art that evaporator package 30, compressor package 50 and condenser package 70 may include other valves and controls for the operation of ice cube-making machine 20. A heat exchanger loop 87 is in thermal relationship with the liquid refrigerant in accumulator so as to optimize the use thereof during the freeze cycle.

Figure 4:
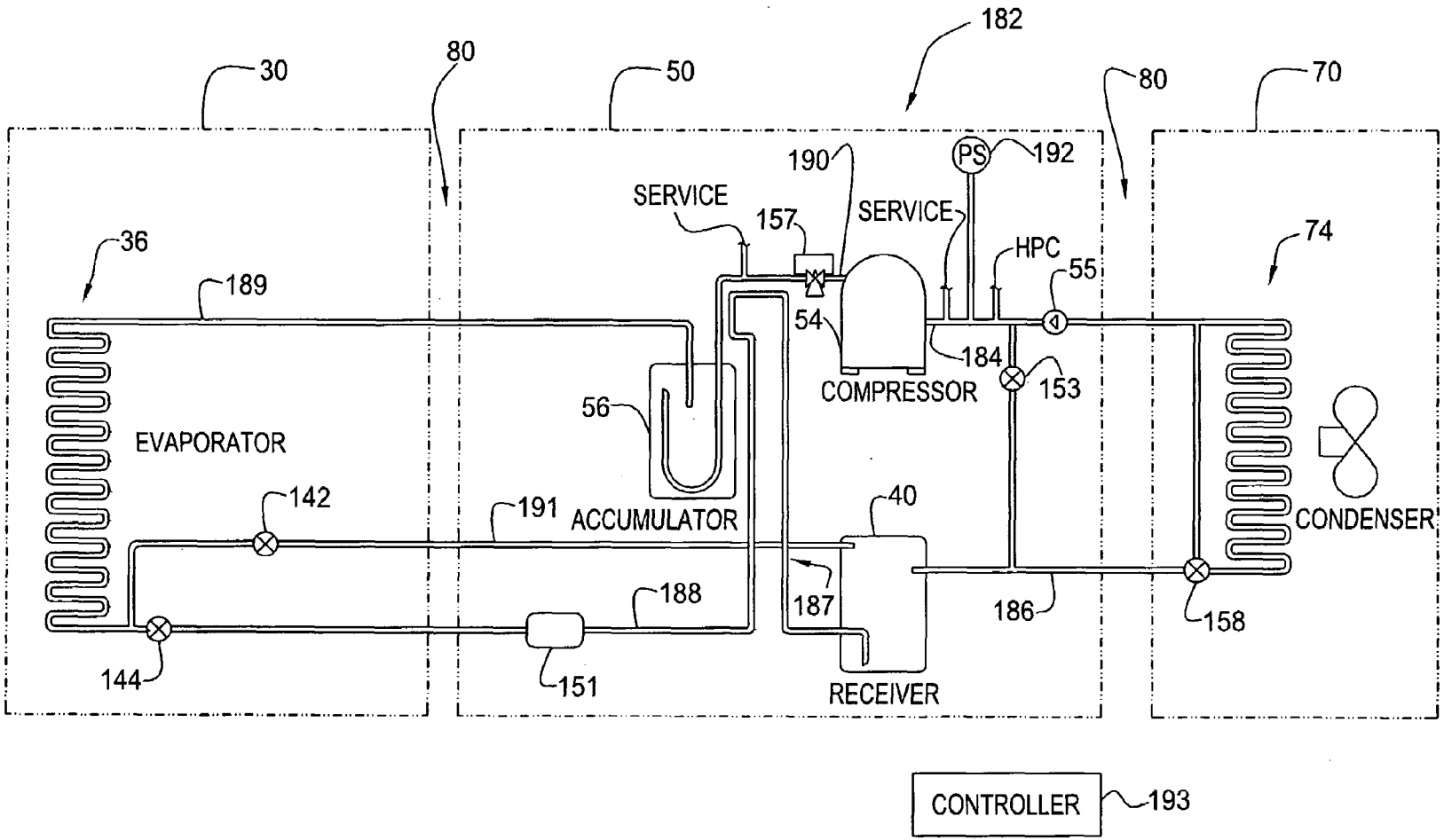
FIG. 4 is a circuit diagram of an alternative refrigerant/warm gas circuit that can be used for the ice-making machine of FIG. 1.

Referring to FIG. 4, a circuit 182 is shown that may be used with ice cube-making machine 20 of FIG. 1. Circuit 182 includes interconnection structure 80 that connects the components within compressor package 50 to the components within evaporator package 30 and to the components within condenser package 70. In evaporator package 30, evaporator 36 is connected in circuit 182 with a defrost or cool vapor valve 142 and an expansion valve 144. In compressor package 50, receiver 40, compressor 54 and accumulator 56 are connected in circuit 182 with a filter 151, a bypass valve 153 and an output pressure regulator 157. In condenser package 70, condenser 74 is connected in circuit 182 with a head master or head pressure control valve 158. A heat exchanger loop 187 is in thermal relationship with an output tube of accumulator 56 to optimize the use of liquid refrigerant in the accumulator during the freeze cycle.

It will be appreciated by those skilled in the art that evaporator package 30, compressor package 50 and condenser package 70 may include other valves and controls for the operation of ice cube-making machine 20. For example, ice-making machine 20 includes a controller 193 that controls the operations thereof including the activation of bypass solenoid valve 153 during the harvest cycle. Alternatively, a pressure switch 192 during harvest mode can activate solenoid valve 153.

According to a feature of the present invention output pressure valve 157 operates to raise pressure and temperature of the refrigerant in evaporator 36 during ice harvesting.

During a freeze cycle, cool vapor valve 142 and bypass valve 153 are closed and expansion valve 144 is open. Refrigerant flows from an output 184 of compressor 54 via a line 185, condenser 74, head pressure control valve 158, a line 186, receiver 40. Flow continues via heat exchanger loop 187, a supply line 188, filter 151, expansion valve 144, evaporator 36, a return line 189, accumulator 56, output pressure regulator 157 to an input 190 of compressor 54. Output pressure regulator 157 is wide open during the freeze cycle such that the refrigerant passes without any impact on flow.

During a harvest cycle, cool vapor valve 142 and bypass valve 153 are open and expansion valve 144 is closed. Refrigerant in vapor phase flows from the output of compressor 54 via either or both of bypass valve 153 or head pressure valve 158 through line 186 to receiver 40. Flow continues via a vapor line 191, cool vapor valve 142, evaporator 36, return line 189, accumulator 56, output pressure regulator 157 to input 190 of compressor 54.

Output pressure regulator 157 operates during harvest to slow the flow and decrease pressure at input 190 to compressor 54. This results in a higher pressure in evaporator 36 and higher temperature of the vapor in evaporator 36. The higher temperature refrigerant in evaporator 36 enhances the harvest cycle.

Output pressure regulator 157 may be any suitable pressure regulator that is capable of operation at the pressure required in ice-making systems. For example, output pressure regulator may be Model No. OPR 10 available from Alco.

Figure 5:
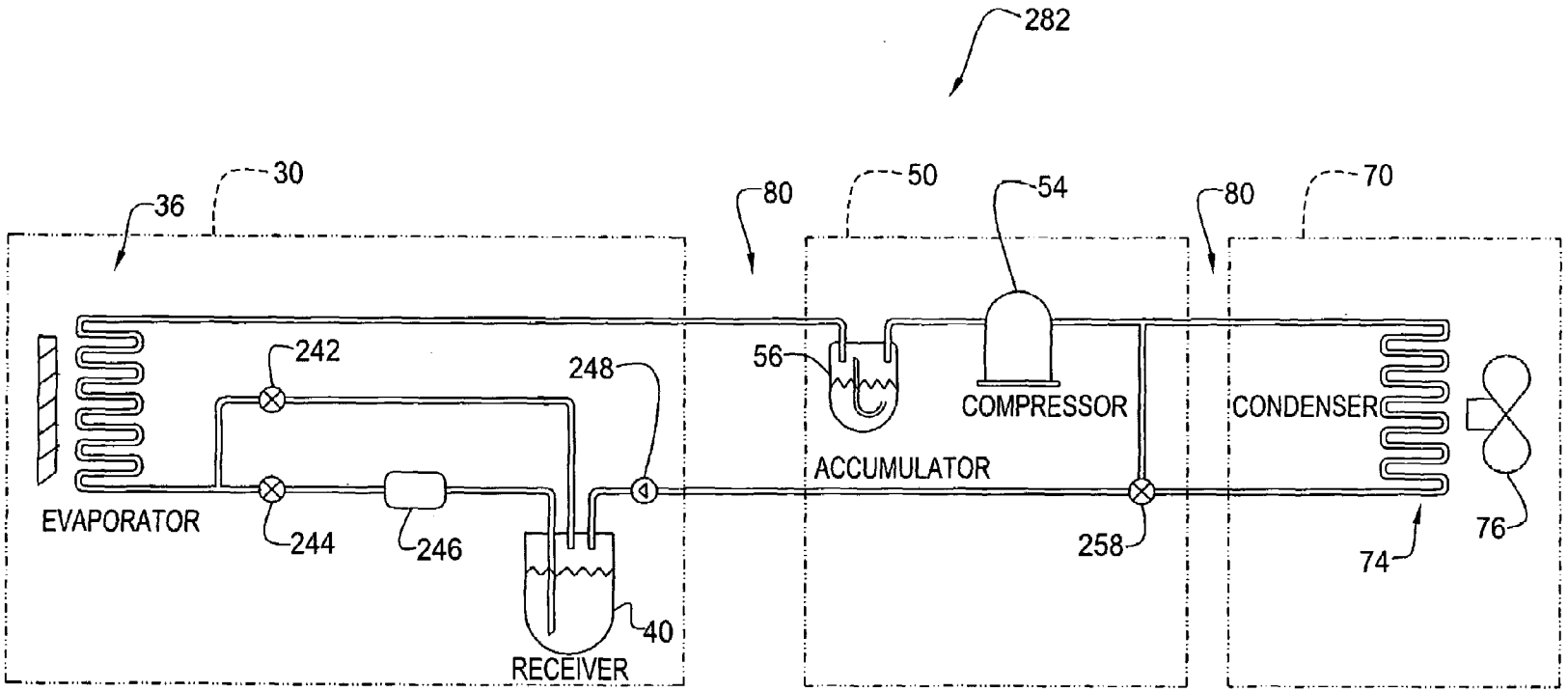
FIG. 5 is a circuit diagram of an alternative refrigerant/warm gas circuit that can be used for the ice-making machine of FIG. 2.

Referring to FIG. 5, a circuit 282 is shown that may be used with ice cube-making machine 25 of FIG. 2. Circuit 282 includes interconnection structure 80 that connects the components within compressor package 50 to the components within evaporator package 30 and to the components within condenser package 70. In evaporator package 30, evaporator 36 and receiver 40 are connected in circuit 282 with a defrost valve 242, an expansion valve 244, a drier 246 and a check valve 248. In compressor package 50, compressor 54 and accumulator 56 are connected in circuit 282 with a head pressure control valve 258. In condenser package 70, condenser 74 is connected in circuit 282. Head pressure control valve 258 may alternatively be placed in condenser package 70. It will be appreciated by those skilled in the art that evaporator package 30, compressor package 50 and condenser package 70 may include other valves and controls for the operation of ice cube-making machine 20.

Ice cube-making machines 20 and 25 of the present invention provide the advantage of lightweight packages for ease of installation. In most cases, a crane will not be needed. In addition, the evaporator package is rather quiet in operation, as the compressor and the condenser are remotely located. Finally, the distance between evaporator package 30 and condenser package 70 is greatly enhanced to approximately 70 feet in height from the 35 feet height constraint of the prior art two package system.

Figure 6:
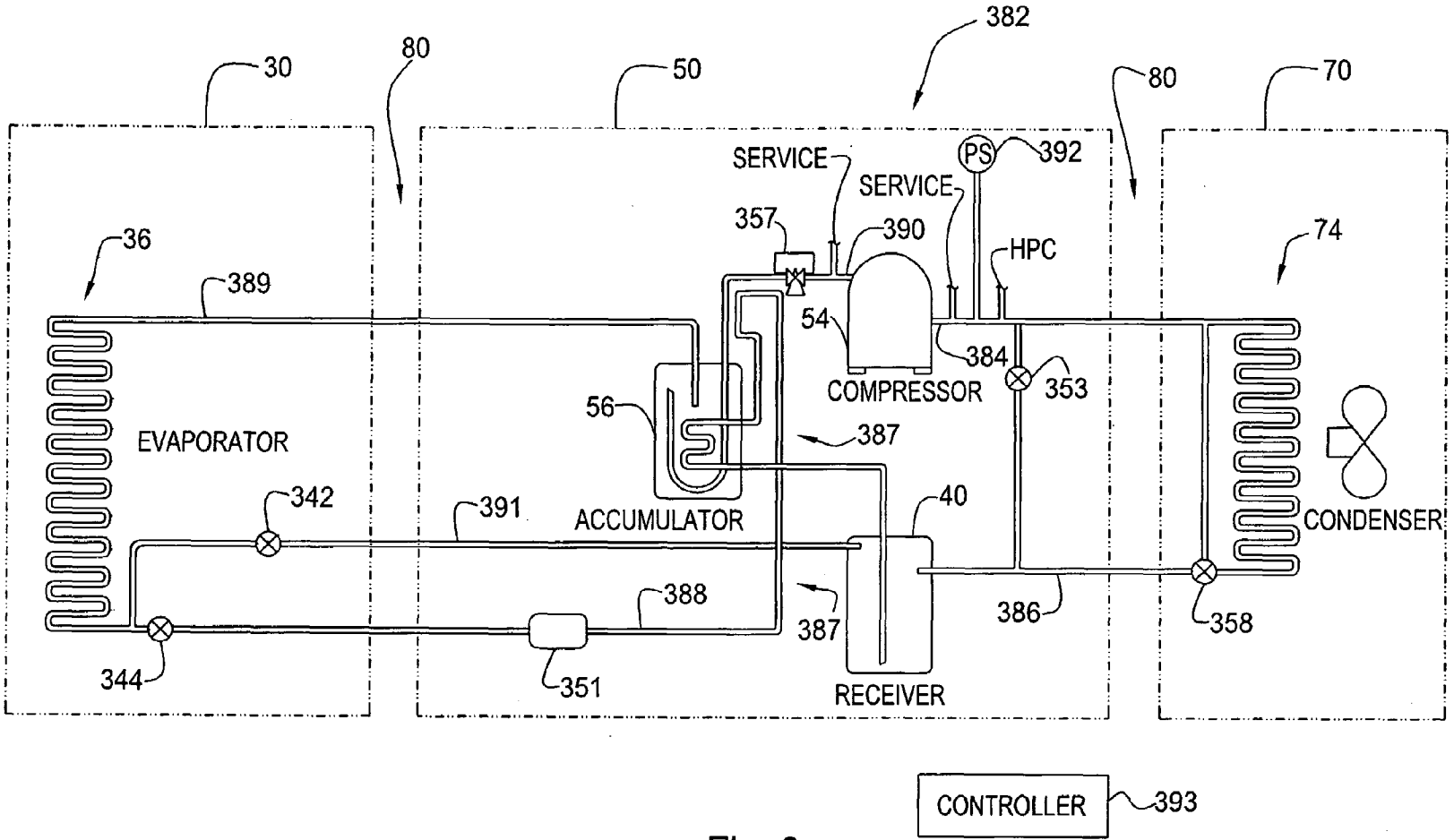
FIG. 6 is circuit diagram of another alternative refrigerant/warm gas circuit that can be used for the ice-making machine of FIG. 1.

Referring to FIG. 6, a circuit 382 is shown that may be used with ice cube-making machine 20 of FIG. 1. Circuit 382 includes interconnection structure 80 that connects the components within compressor package 50 to the components within evaporator package 30 and to the components within condenser package 70. In evaporator package 30, evaporator 36 is connected in circuit 382 with a defrost or cool vapor valve 342 and an expansion valve 344. In compressor package 50, receiver 40, compressor 54 and accumulator 56 are connected in circuit 382 with a filter 351, a bypass valve 353, a head master or head pressure control valve 358 and an output pressure regulator 357. A heat exchanger loop 387 passes through accumulator 56 and is in thermal relationship with an output tube of accumulator 56 to optimize the use of liquid refrigerant in the accumulator during the freeze cycle.

It will be appreciated by those skilled in the art that evaporator package 30, compressor package 50 and condenser package 70 may include other valves and controls for the operation of ice cube-making machine 20. For example, ice-making machine 20 includes a controller 393 that controls the operations thereof including the activation of bypass solenoid valve 353 during the harvest cycle. Alternatively, a pressure switch 392 during harvest mode can activate solenoid valve 353.

According to a feature of the present invention output pressure valve 357 operates to raise pressure and temperature of the refrigerant in evaporator 36 during ice harvesting.

During a freeze cycle, cool vapor valve 342 and bypass valve 353 are closed and expansion valve 344 is open. Refrigerant flows from an output 384 of compressor 54 via a line 385, condenser 74, head pressure control valve 358 and a line 386 to receiver 40. Flow continues via heat exchanger loop 387, a supply line 388, filter 351, expansion valve 344, evaporator 36, a return line 389, accumulator 56, output pressure regulator 357 to an input 390 of compressor 54. Output pressure regulator 357 is wide open during the freeze cycle such that the refrigerant passes without any impact on flow.

During a harvest cycle, cool vapor valve 342 and bypass valve 353 are open and expansion valve 344 is closed. Refrigerant in vapor phase flows from the output of compressor 54 to a vapor line 391 via either or both of a first path that includes bypass valve 353 or a second path that includes head pressure valve 358 line 386 and receiver 40. Flow continues via vapor line 391, cool vapor valve 342, evaporator 36, return line 389, accumulator 56, output pressure regulator 357 to input 390 of compressor 54.

Output pressure regulator 357 operates during harvest to slow the flow and decrease pressure at input 390 to compressor 54. This results in a higher pressure in evaporator 36 and higher temperature of the vapor in evaporator 36. The higher temperature refrigerant in evaporator 36 enhances the harvest cycle.

Figure 7:
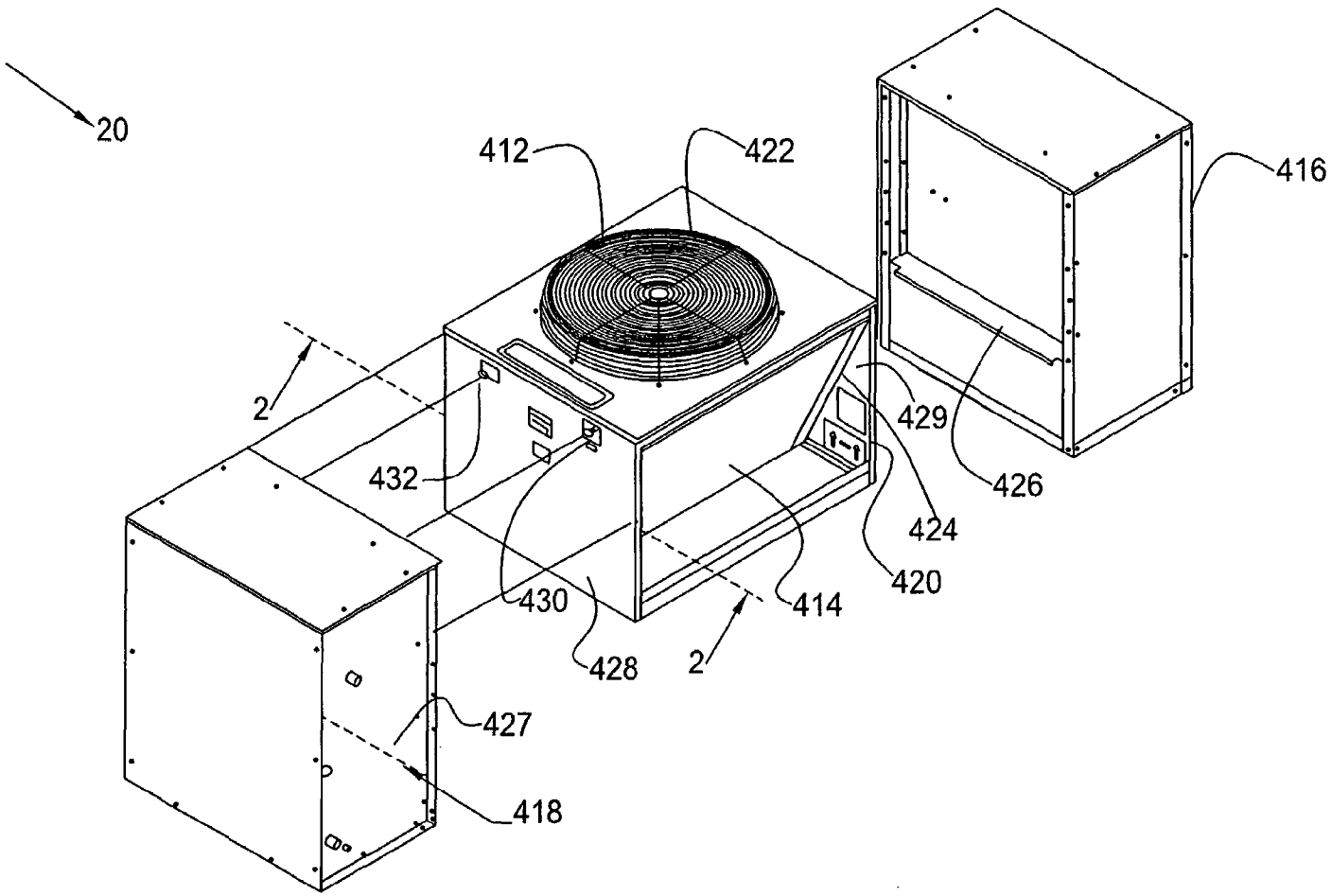
FIG. 7 is a is a perspective view, of another exemplary embodiment of the ice-making machine with the dual loop condenser of the present invention.
Figure 8:
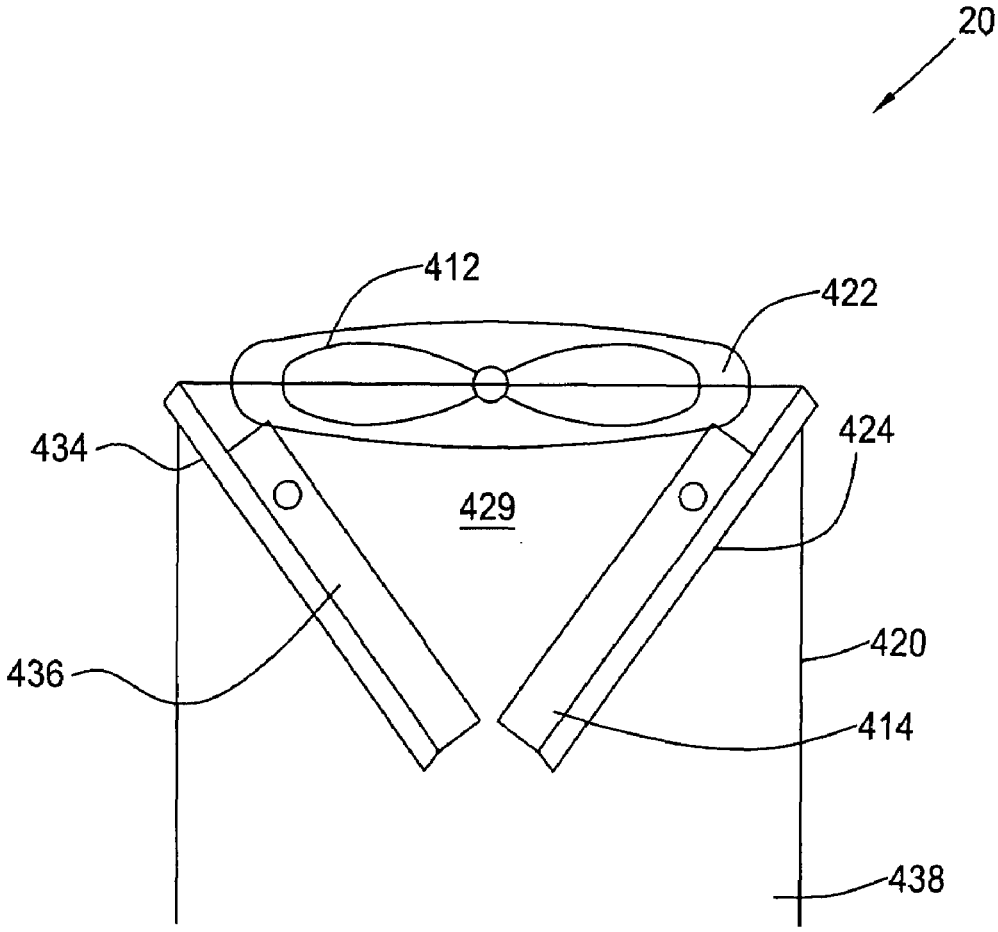
FIG. 8 is a view along line 2-2 of FIG. 7.

Referring now to FIGS. 7 and 8, there is provided another exemplary embodiment of an ice-making machine 20. Ice-making machine 20 includes a single fan 412, a first condenser 414, a second condenser 436, a first compressor 416, and a second compressor 418. The first condenser 414 and the first compressor 416 are adapted to connect with one another to form a first refrigerant circuit that includes an evaporator and the other typical refrigerant components. The second condenser 436 and the second compressor 418 also are adapted to connect with one another in a second refrigerant circuit that includes an evaporator and the other typical refrigerant components. An ice bin or hopper (not shown) may be disposed between an evaporator (not shown) to receive ice cubes during a harvest mode. First condenser 414 and the second condenser 436 rest in a support structure 420. An exemplary aspect of the support structure 420 is that the support structure 420 is a box-like structure having an aperture 422. Aperture 422 is a suitable size for allowing fan 412 access to air to circulate and cool the first condenser 414 and second condenser (not shown). It should be appreciated by those skilled in the art, that fan 412 may be disposed in any suitable manner to cool first condenser 416 and second condenser 436.

Support structure 420 also includes a first support element 424 and a second support element 434. First support element 424 and second support element 434 are attached to one another. First support element 424 and second support element 434 are configured to be attached by any known method in the art for connecting the first support element 424 and the second support element 434 in a V configuration. The first condenser 414 and the second condenser 436 rest upon the respective first support element 424 and the second support element 434 within support structure 420.

First support element 424 is attached to the interior of support structure 420 to provide suitable structural support to first condenser 414. Second support element 434 is also attached to the interior of support structure 420 to provide suitable structural support to second condenser 436. An exemplary aspect of first support element 424 and second support element 434 is that first and second support elements are dimensioned to allow an air stream to circulate there through from the ambient via aperture 422. Support structure 420 also has a second aperture 438 disposed on the bottom of support structure 420. Aperture 438 extends the width of the support structure 420 to allow the interior of the support structure 420 to be exposed to the ambient and contribute to cooling of first condenser 414 and second condenser 434 and to contribute to the heat transfer to ambient.

First compressor 416 includes a first flange 426. The second compressor 418 also has a second flange 427. Support structure 420 is adapted to rest on first flange 426 disposed on the first compressor 416 and the second flange 427 on the second compressor 418. Preferably, first flange 426 and second flange 427 are suitable to hold the weight of the support structure 420 with the weight of the first condenser 416 and the second condenser 436 disposed within support structure 420. First compressor 416 and second compressor 418 are positioned such that support structure 420 rests on first flange 426 and second flange 427.

Support structure 420 also includes a first lateral side 428 and a second lateral side 429. Disposed in the first lateral side 428 and second lateral side 429 are a plurality of apertures for connecting the first condenser 414 and second condenser (not shown) to the respective first compressor 416 and second compressor 418.

It should be appreciated by one skilled in that art that although first support element 424 and second support element 434 are connected to the support structure 420 in a V configuration, first and second support elements 424, 434 may arranged in any configuration so as to create a compact configuration of multiple condensers. It should also be appreciated by one skilled in the art, that support structure 420 rests on first flange 426 and second flange 427 so as to provide suitable height, relative to the ground, to allow air to circulate through support structure 420 via aperture 422 and underneath the support structure 420 through second aperture 438 as shown in FIG. 8.

Referring to FIG. 7, first lateral side 429 has a corresponding supply line (not shown) and a return line (not shown) for circulating refrigerant from the first compressor 416 to the first condenser 414 to define the first refrigerant circuits. Second lateral side 428 has corresponding supply line 430 and a corresponding return line 432 for circulating refrigerant from the second compressor 418 to the second condenser (not shown) to define the second refrigerant circuit. The first and second refrigeration circuit may be any suitable refrigeration circuit known in the art or known in the future.

Figure 9:
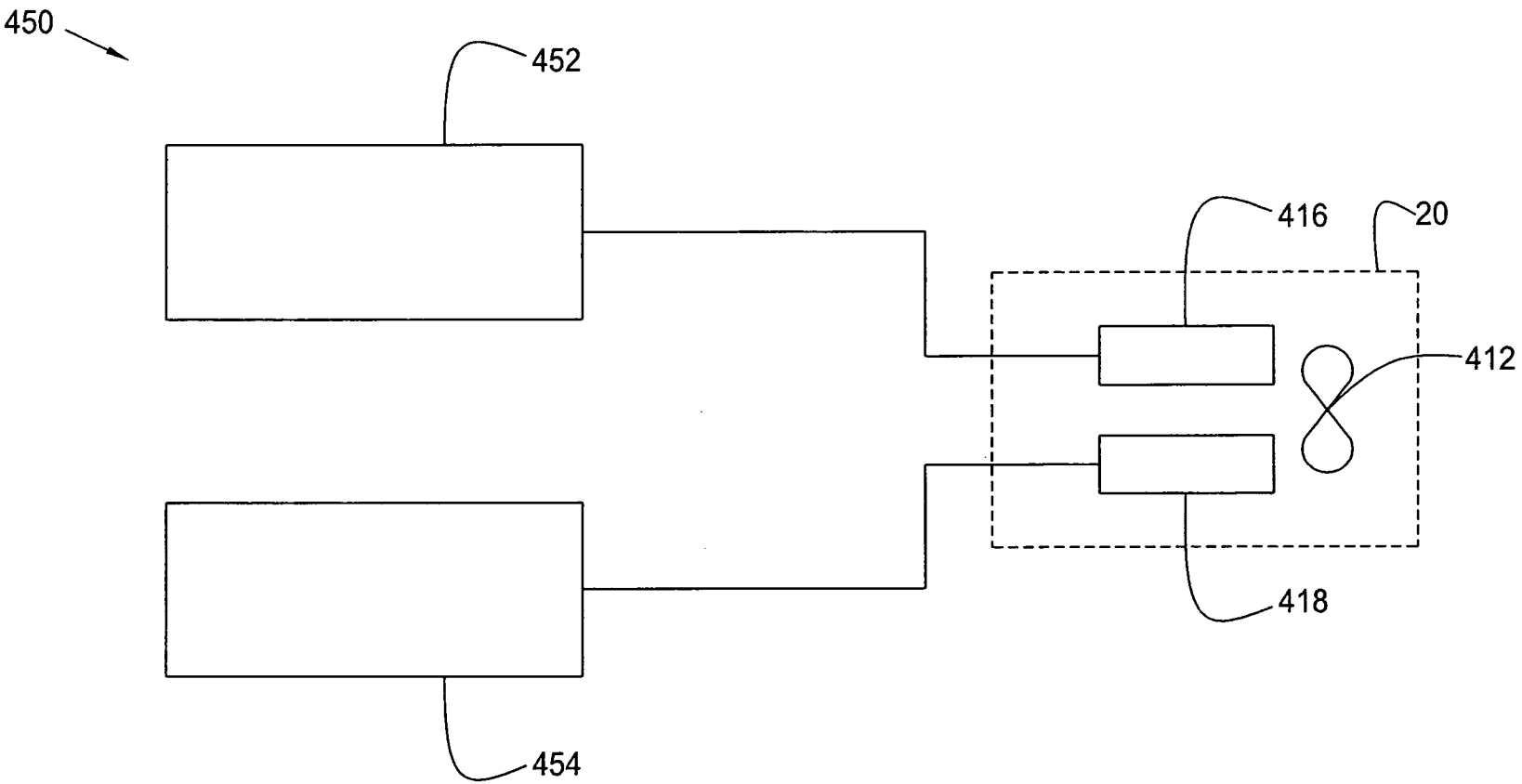
FIG. 9 is a circuit diagram of the ice-making machine of FIG. 7.

With reference to FIG. 9, a circuit 450 is shown that may be used with the FIG. 7 ice-cube-making machine. Circuit 450 includes an interconnection structure that connects the components to form a first ice making system 452. Circuit 450 also includes an interconnection structure that connects the components to form a second ice making system 454. First ice making system 452 is connected to first condenser 416. Second ice making system 454 is connected to second condenser 418. First condenser 416 and second condenser 418 are disposed in support structure 420 adjacent fan 412. First ice making system 452 and the second ice making system 454 may be any suitable ice making system known in the art or known in the future.

Figure 10:
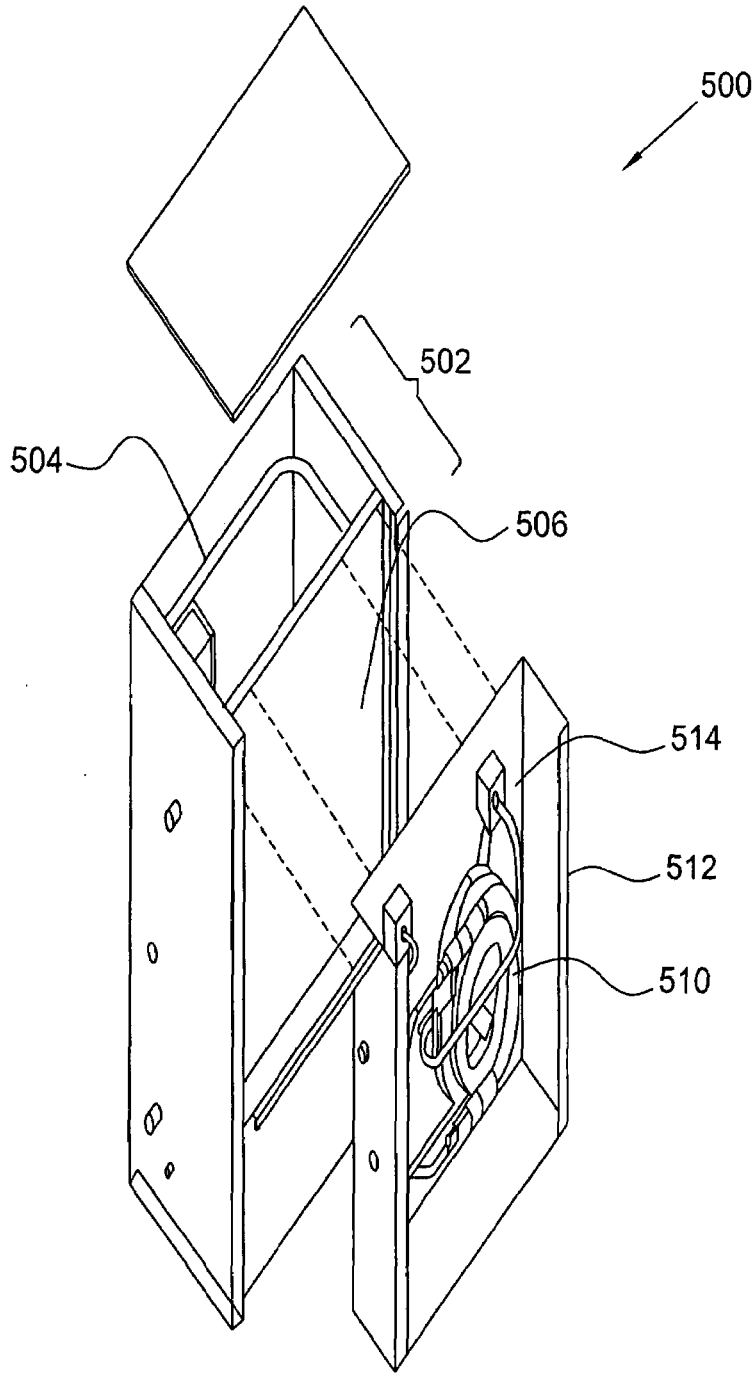
FIG. 10 is a perspective view, of another exemplary embodiment of the ice-making machine with the dual loop condenser of the present invention.

With reference to FIG. 10, there is provided another exemplary embodiment of a package 500 that includes a first compressor 502 and a condenser 510. As will be understood from the drawings, package 500 includes a support structure 504. Support structure 504 is disposed within the interior of compressor package 502. An exemplary aspect of compressor package 502 is that support structure 504 houses a compressor (not shown). As will be appreciated by one skilled in the art, air cooled condensers are not economically feasible given the space requirements and location of the condensers disposed in smaller, urban locations. For example, in urban locations when the compressor package 502 is located in the lower floor of a building and the roof is more than thirty five feet above, the air cooled condensers will not be able to function in a beneficial capacity, given the heat transfer experienced in the thirty five feet distance. This limiting aspect can be detrimental in urban installations, given the existence of high rise buildings. If the packages are placed closer to each other to utilize air cooled condensers, this may result in a more noisy ice-cube making machine.

However, generally high rise buildings typically have an abundant supply of chilled water or fluid. These chilled water or fluid systems are circulating throughout the building. As such, the present exemplary embodiment, utilizes the abundant chilled water supply to provide the customer even greater installation flexibility of the compressor package 502. Referring to FIG. 10, there is provided a compressor package 502. Compressor package 502 has a support structure 504. Preferably, compressor package 502 includes an aperture 506 disposed in a lateral side of compressor package 502. Aperture 506 reveals a lateral side of support structure 504. Aperture 506 is of a suitable depth to mate with an insert package 512. Insert package 512 houses a water cooled condenser 510 and a water regulating valve 514. As will be understood, water regulating valve 514 may be any suitable device for connecting the building's chilled water system to condenser 510 and the attendant refrigerant circuit (not shown). It should be appreciated that any suitable refrigerant circuit known in the art may be used in the present embodiment. It should also be appreciated by one skilled in the art, that insert package 512 may be attached to compressor package 502 by any suitable fasteners currently known in the art or known in the future. In this manner, the compressor package 502 may be installed at a suitable remote distance away from, for example the evaporator (not shown) while simultaneously not squandering productive operational cooling qualities that are normally lost from heat transfer over a greater distance than about 35 feet.

Figure 11:
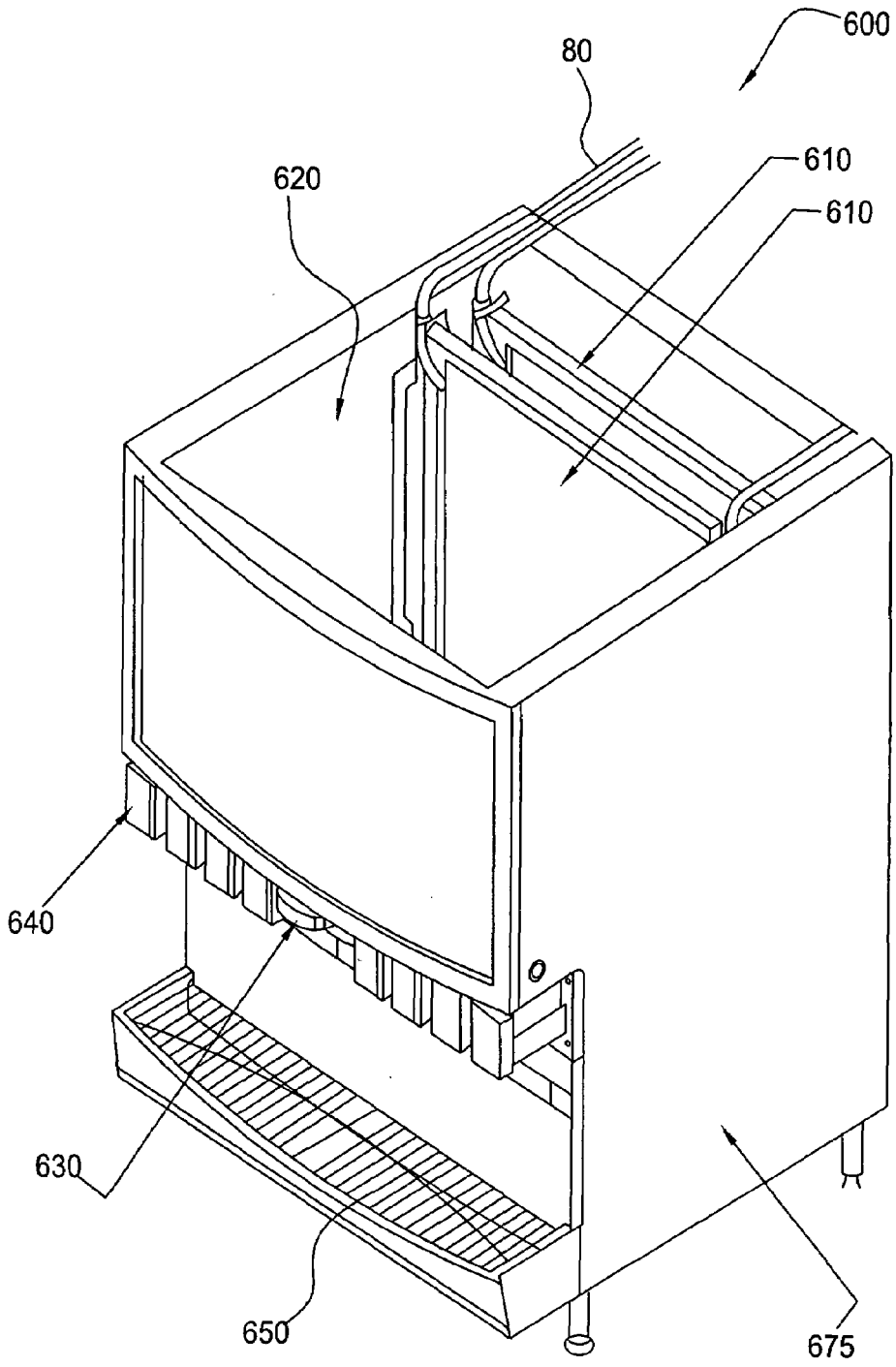
FIG. 11 is a perspective view of an exemplary embodiment of an integrated ice and beverage dispensing system for use with the ice-making machine of the present invention.

Referring to FIG. 11, an integrated ice and beverage dispenser is shown and generally represented by reference numeral 600. Integrated dispenser 600 has evaporators 610, ice hopper or storage bin 620, ice dispenser 630, beverage dispenser 640 and drain 650. Preferably, these components of integrated dispenser 600 are integrally connected by a dispenser structure 675 to form a unitary device. However, the present disclosure contemplates the use of other designs and support structures to provide evaporators 610, ice storage bin 620, ice dispenser 630, beverage dispenser 640 and/or drain 650 in operable communication with each other such that they are in close proximity and usable with one another, but may alternatively not be attached to each other. Integrated dispenser 600 is usable with the ice-making machines as described herein for FIGS. 1 through 10, as well as other known ice-making machines.

Evaporators 610 have interconnection structure 80, which may suitably include pipes or tubing and appropriate joining junctions, that places the evaporators in fluid communication with the compressor (not shown), the condenser (not shown) and other components of the ice-making machines described herein (not shown) for circulation of refrigerant. In this exemplary embodiment two evaporators 610 are shown, although any number of evaporators can be used. The integrated dispenser 600 allows formation of ice during the harvest cycle, as well as dispensing of the ice at the same location as the dispensing of the beverages through beverage dispenser 640. This avoids any time-consuming and labor-intensive manual loading of the ice storage bin 620, and provides easy access to both beverages and ice.

The evaporators 610 are operably connected to a water supply (not shown) to provide water for the formation of the ice at the evaporators to be stored in ice storage bin 620. Ice dispenser 630 can be a chute, or other type of dispenser, such as, for example gravity actuated or power actuated, which provides ice to the user upon demand. The integrated ice dispenser 600 includes a drain 650 for overflow of the beverages from the beverage dispenser 640, as well as for dispensed ice that goes unused. The beverage dispenser 640 can be a plurality of beverage dispensers, which are each in fluid communication with one or more different sources to provide a variety of beverages.

Integrated dispenser 600 is disposed in an area accessible to users and is remotely located from the compressor unit (not shown) and the condenser unit (not shown). In an exemplary embodiment, integrated dispenser 600 is part of a three package system where the dispenser (which has the evaporator), the compressor and the condenser are remotely located from each other for quiet operation. However, the present disclosure contemplates the use of the integrated dispenser 600 with a two package system, as well as with the other embodiments of the ice-making machines described herein.

While the instant disclosure has been described with reference to one or more exemplary or preferred embodiments, it will be understood by those skilled in the art that various changes may be made and equivalents may be substituted for elements thereof without departing from the scope thereof. In addition, many modifications may be made to adapt a particular situation or material to the teachings of the disclosure without departing from the scope thereof. Therefore, it is intended that the disclosure not be limited to the particular embodiment(s) disclosed as the best mode contemplated for carrying out this invention, but that the invention will include all embodiments falling within the scope of the appended claims.

What is claimed is:

1. An integrated ice and beverage dispensing system for use with a compressor, a condenser, a water supply and a beverage source, the system comprising:

a support structure;

a beverage dispenser in fluid communication with the beverage source; and an evaporator in fluid communication with said compressor and said condenser for the circulation of refrigerant, wherein said beverage dispenser and said evaporator are housed by and integrally connected with said support structure to form a unitary device, wherein said support structure is located remotely from said compressor, said condenser, the water supply and the beverage source, wherein said evaporator is operably connected to the water supply for forming ice at said evaporator, wherein the integrated ice and beverage dispensing system is non-modular, and wherein said support structure further comprises a plurality of walls, wherein said evaporator is positioned adjacent one of said plurality of walls, and wherein said evaporator and a remainder of said plurality of walls define an ice storage bin for receiving said ice formed at said evaporator.

2. An integrated ice and beverage dispensing system for use with a compressor, a condenser, a water supply and a beverage source, the system comprising:

a support structure having a plurality of walls;

a beverage dispenser in fluid communication with the beverage source; and a plurality of evaporators in fluid communication with said compressor and said condenser for the circulation of refrigerant, wherein said beverage dispenser and said plurality of evaporators are housed by and integrally connected with said support structure to form a unitary device, wherein said support structure is located remotely from said compressor, said condenser, the water supply and the beverage source, wherein said plurality of evaporators are operably connected to the water supply for forming ice at said plurality of evaporators, wherein the integrated ice and beverage dispensing system is non-modular, and wherein said plurality of evaporators are positioned adjacent at least one of said plurality of walls.

3. The system of claim 2, wherein said plurality of evaporators and a remainder of said plurality of walls define an ice storage bin for receiving said ice formed at said plurality of evaporators.

4. The system of claim 2, wherein said support structure further comprises a plurality of walls, and wherein said plurality of evaporators are positioned adjacent only one of said plurality of walls, and wherein said plurality of evaporators and a remainder of said plurality of walls define an ice storage bin for receiving said ice formed at said plurality of evaporators.

5. An integrated ice and beverage dispensing system for use with a compressor, a condenser, a water supply and a beverage source, the system comprising:

a support structure having a plurality of walls;

a plurality of beverage dispensers in fluid communication with the beverage source; and an evaporator in fluid communication with said compressor and said condenser for the circulation of refrigerant, wherein said plurality of beverage dispensers and said evaporator are housed by and integrally connected with said support structure to form a unitary device, wherein said support structure is located remotely from said compressor, said condenser, the water supply and the beverage source, wherein said evaporator is operably connected to the water supply for forming ice at said evaporator, wherein the integrated ice and beverage dispensing system is non-modular, wherein said evaporator is positioned adjacent a rear wall of said plurality of walls, wherein said plurality of beverage dispensers are positioned along a front wall of said plurality of walls, and wherein said evaporator and a remainder of said plurality of walls define an ice storage bin for receiving said ice formed at said evaporator.

6. The system of claim 5, wherein said evaporator is a plurality of evaporators that are positioned adjacent said rear wall of said plurality of walls.

7. The system of claim 6, wherein said plurality of evaporators and said remainder of said plurality of walls define said ice storage bin for receiving said ice formed at said plurality of evaporators.

* * * * *